US009896827B1

(12) United States Patent
Hsieh et al.

(10) Patent No.: US 9,896,827 B1
(45) Date of Patent: Feb. 20, 2018

(54) DRAINAGE OVERFLOW PIPE STRUCTURE FOR BATHTUB

(71) Applicant: Horng Lai Industrial Co., Ltd., Chang Hua Hsien (TW)

(72) Inventors: Cheng-Yeh Hsieh, Chang Hua Hsien (TW); Chia-Yi Hsieh, Chang Hua Hsien (TW)

(73) Assignee: Horng Lai Industrial Co., Ltd., Chang Hua Hsien (TW)

( * ) Notice: Subject to any disclaimer, the term of this patent is extended or adjusted under 35 U.S.C. 154(b) by 0 days.

(21) Appl. No.: 15/430,933

(22) Filed: Feb. 13, 2017

(51) Int. Cl.

| | |
|---|---|
| ***E03C 1/232*** | (2006.01) |
| ***E03C 1/20*** | (2006.01) |
| ***F16L 27/02*** | (2006.01) |
| ***E03C 1/24*** | (2006.01) |
| *A47K 3/02* | (2006.01) |

(52) U.S. Cl.
CPC ..... *E03C 1/232* (2013.01); *E03C 1/20* (2013.01); *E03C 1/24* (2013.01); *F16L 27/02* (2013.01); *A47K 3/02* (2013.01)

(58) Field of Classification Search
CPC ..... E03C 1/20; E03C 1/22; E03C 1/23; E03C 1/232; E03C 1/24; A47K 3/02; F16L 27/02
USPC ..... 4/680
See application file for complete search history.

(56) References Cited

U.S. PATENT DOCUMENTS

| | | | | |
|---|---|---|---|---|
| 3,931,992 | A * | 1/1976 | Coel | F16L 27/073 285/271 |
| 4,904,228 | A * | 2/1990 | Frear | E21B 17/05 464/152 |
| 4,920,582 | A * | 5/1990 | Alker | E03C 1/232 4/683 |
| 6,687,926 | B1 * | 2/2004 | Bayley | E03C 1/22 4/681 |
| 2008/0155745 | A1 * | 7/2008 | Burr | E03C 1/232 4/683 |
| 2015/0089736 | A1 * | 4/2015 | Bird | E03C 1/22 4/680 |
| 2015/0285418 | A1 * | 10/2015 | Rempert | F16L 41/18 285/363 |
| 2016/0177554 | A1 * | 6/2016 | Yu | E03C 1/232 4/685 |
| 2016/0186418 | A1 * | 6/2016 | Yu | E03C 1/232 4/682 |

* cited by examiner

*Primary Examiner* — J. Casimer Jacyna
(74) *Attorney, Agent, or Firm* — Alan D. Kamrath; Kamrath IP Lawfirm, P.A.

(57) ABSTRACT

A drainage overflow pipe structure for a bathtub, wherein an overflow pipe of the drainage overflow pipe structure is mounted on a bathtub, and the drainage overflow pipe contains: a tee part, a drainage part, an overflow part, a pipe elbow, and a universal rotation assembly. The tee part includes a first coupling orifice, a second coupling orifice, and a third coupling orifice. The drainage part is connected with the first coupling orifice and the drainage hole. The overflow part includes a joining section and a connecting seat which has outer threads and a groove-shaped holding portion. The pipe elbow includes an inlet and an outlet. The universal rotation assembly includes a connector and a limitation member, wherein the connector has a screwing portion, a spherical knob, and a through orifice, and the limitation member includes inner threads.

4 Claims, 9 Drawing Sheets

DRAINAGE OVERFLOW PIPE STRUCTURE FOR BATHTUB

BACKGROUND OF THE INVENTION

Field of the Invention

The present invention relates to a drainage overflow pipe structure, and more particularly to the drainage overflow pipe structure which is applicable for bathtubs of various specifications.

Description of the Prior Art

A conventional bathtub is in a tub shape and is applicable for having a bath. The bathtub contains a storage tank, a drainage pipe connected on a bottom of the storage tank so as to drain water out of a draining orifice of the drainage pipe. The storage tank has an overflow orifice defined on a peripheral wall thereof and connecting with an overflow pipe so as to avoid water leakage from the bathtub. However, the drainage pipe and the overflow pipe are integrated in a drainage overflow pipe structure.

As illustrated in FIGS. 1 and 2, a conventional drainage overflow pipe structure contains a drainage overflow pipe including a tee part 10, a draining part 20, an overflow part 30, a pipe elbow 40, and a discharge part 50. The tee part 10 includes a first coupling orifice 101, a second coupling orifice 102, and a third coupling orifice 103 which are in communication with each other. A first end of the draining part 20 is inserted into the first coupling orifice 101 of the tee part 10, and a second end of the draining part 20 is connected with a drainage hole (not shown) of a bathtub 60. The overflow part 30 has an insertion segment 301 and a screwing segment 302 opposite to the insertion segment 301, wherein the insertion segment 301 is inserted into the second coupling orifice 102 of the tee part 10. A first end of the pipe elbow 40 is coupled with an overflow orifice 61 of the bathtub 60, and a second end of the pipe elbow 40 screws with the screwing segment 302 of the overflow part 30, the discharge part 50 joins with the third coupling orifice 103 of the tee part 10. As desiring to discharge water in the storage tank of the bathtub 60, a seal plug on the drainage hole of the bathtub 60 is removed so that the water in the storage tank of the bathtub 60 discharges out of the discharge part 50 from the drainage hole via the draining part 20 and the tee part 10. When a water level of the storage tank of the bathtub 60 is higher than the overflow orifice 61, the water in the storage tank of the bathtub 60 discharges out of the discharge part 50 from the overflow orifice 61 via the pipe elbow 40, the overflow part 30, and the tee part 10 so as to maintain the highest water lever of the bathtub 60.

Nevertheless, the pipe elbow 40 is screwed with the overflow part 30 in a fixed angle, so the pipe elbow 40 is only applicable for the bathtub 60 in a fixed specification, and the overflow part 30 cannot mating abut against an outer wall of the bathtub, thus increasing installation space.

The present invention has arisen to mitigate and/or obviate the afore-described disadvantages.

SUMMARY OF THE INVENTION

The primary objective of the present invention is to provide a drainage overflow pipe structure in which an overflow part connects and communicates with a pipe elbow by using the universal rotation assembly so that the pipe elbow is rotated universally based on a peripheral wall of bathtubs of various specifications, and an inlet of the pipe elbow matingly contacts with the peripheral wall of the bathtub, hence the pipe elbow is applicable for the bathtubs of various specifications.

Another objective of the present invention is to provide a drainage overflow pipe structure in which the overflow part connects and communicates with the pipe elbow by using the universal rotation assembly so that the pipe elbow is rotated universally relative to the overflow part so as to adjust an angle between the pipe elbow and the overflow part, hence the overflow part matingly contacts with the peripheral wall of the bathtub so as to decrease installation space of the overflow part.

To obtain above-mentioned objectives, a drainage overflow pipe structure for a bathtub provided by the present invention, wherein an overflow pipe of the drainage overflow pipe structure is mounted on a bathtub, and the bathtub includes a water storage tank, the water storage tank has a bottom and a peripheral wall extending upwardly from the bottom, the bottom has a drainage hole, the peripheral wall has an overflow hole, and the drainage overflow pipe contains: a tee part, a drainage part, an overflow part, a pipe elbow, and a universal rotation assembly.

The tee part includes a first coupling orifice, a second coupling orifice, and a third coupling orifice.

A first end of the drainage part is connected with the first coupling orifice of the tee part, and a second end of the drainage part is coupled with the drainage hole of the bathtub.

The overflow part includes a joining section formed on a lower end of the overflow part, and the overflow part includes a connecting seat arranged on an upper end of the overflow part, the joining section is accommodated in the second coupling orifice of the tee part, the connecting seat has outer threads defined on an outer rim of the connecting seat, and the connecting seat has a groove-shaped holding portion formed in an inner rim of the connecting seat.

The pipe elbow includes an inlet defined on a first end of the pipe elbow and coupling with the overflow hole, and the pipe elbow includes an outlet formed on a second end of the pipe elbow.

The universal rotation assembly includes a connector and a limitation member, wherein the connector has a screwing portion, a spherical knob, and a through orifice defined in the screwing portion and the spherical knob so that water flows through the screwing portion and the spherical knob, the screwing portion screws with the outlet of the pipe elbow, the spherical knob fits on the holding portion of the connecting seat of the overflow part, the limitation member is in a ring shape, and the limitation member includes inner threads formed on an inner wall thereof and includes an abutting portion above the inner threads, the limitation member fits on the spherical knob of the connector, and the inner threads of the limitation member screws with the outer threads of the connecting seat of the overflow part so that the abutting portion of the limitation member matches with the holding portion of the connecting seat of the overflow part to force the spherical knob of the connector, and the spherical knob rotates universally and does not move, hence the overflow part connects and communicates with the pipe elbow by using the universal rotation assembly, and the pipe elbow rotates relative to the overflow part by using the universal rotation assembly.

DETAILED DESCRIPTION OF THE PREFERRED EMBODIMENTS

Figure 1:
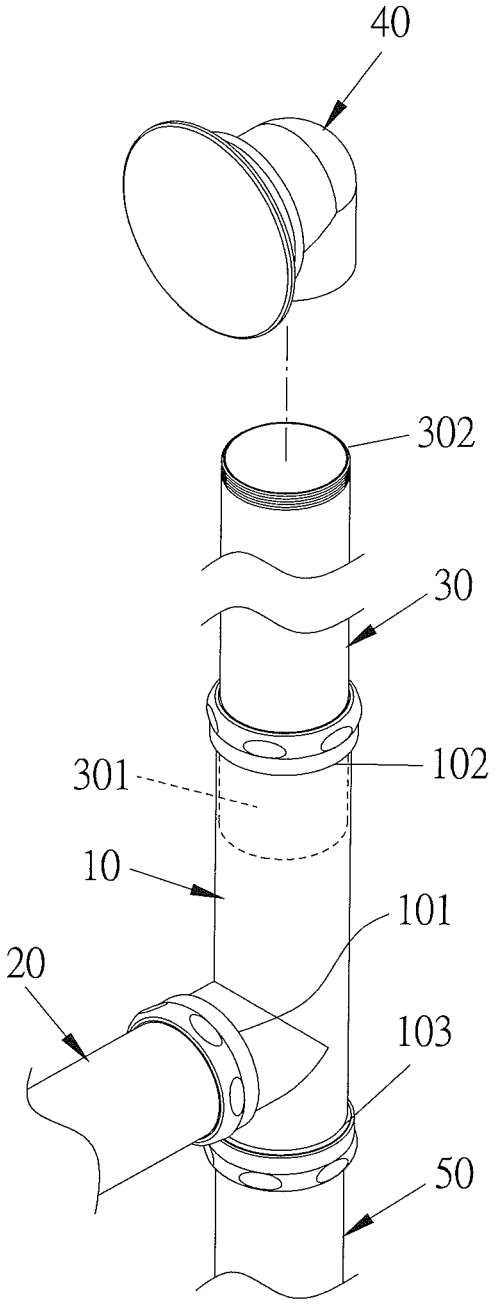
FIG. 1 Prior Art
FIG. 1 is a perspective view of a conventional drainage overflow pipe structure for a bathtub.
Figure 2:
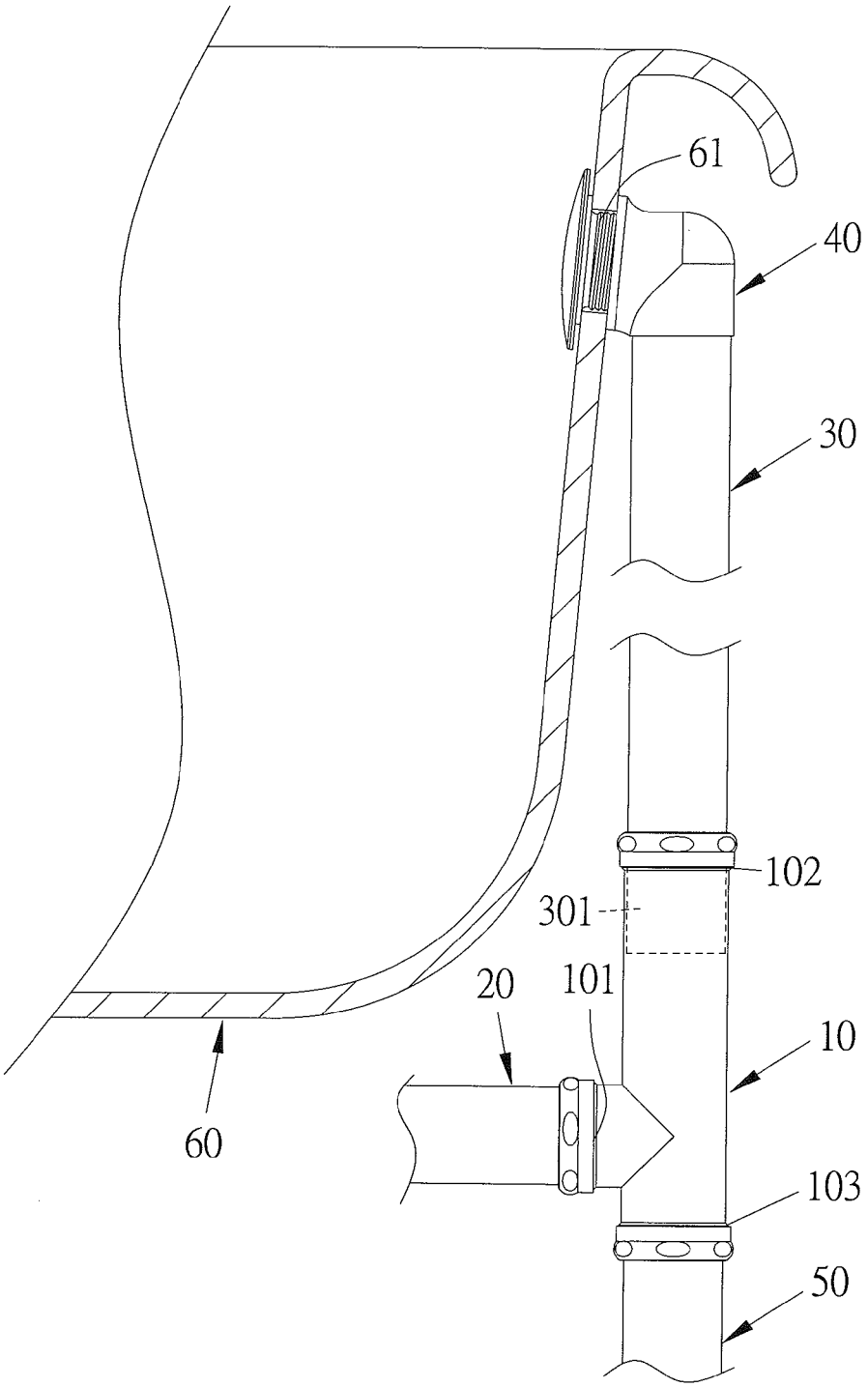
FIG. 2 Prior Art
FIG. 2 is a cross sectional view of the conventional drainage overflow pipe structure for the bathtub.
Figure 3:
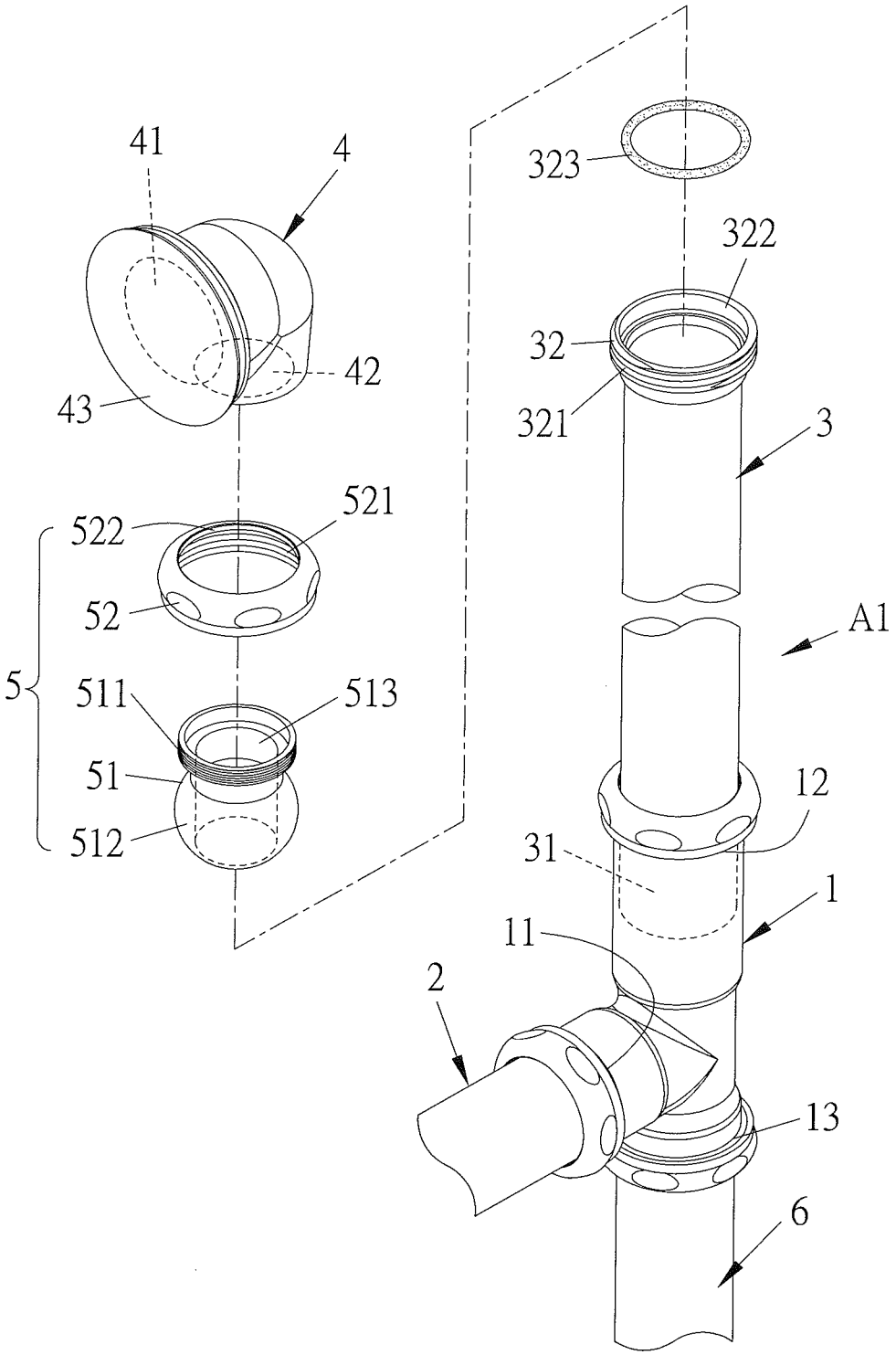
FIG. 3 is a perspective view showing the exploded components of a drainage overflow pipe structure for a bathtub according to a preferred embodiment of the present invention.
Figure 4:
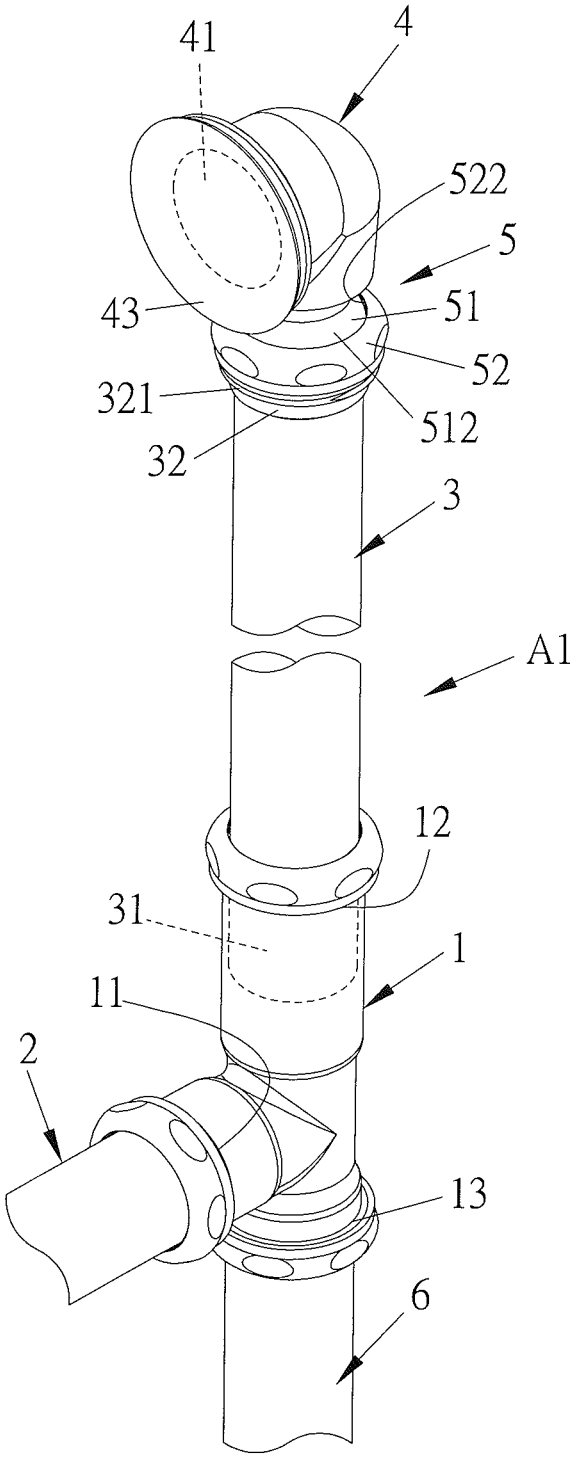
FIG. 4 is a perspective view showing the assembly of the drainage overflow pipe structure for the bathtub according to the preferred embodiment of the present invention.
Figure 5:
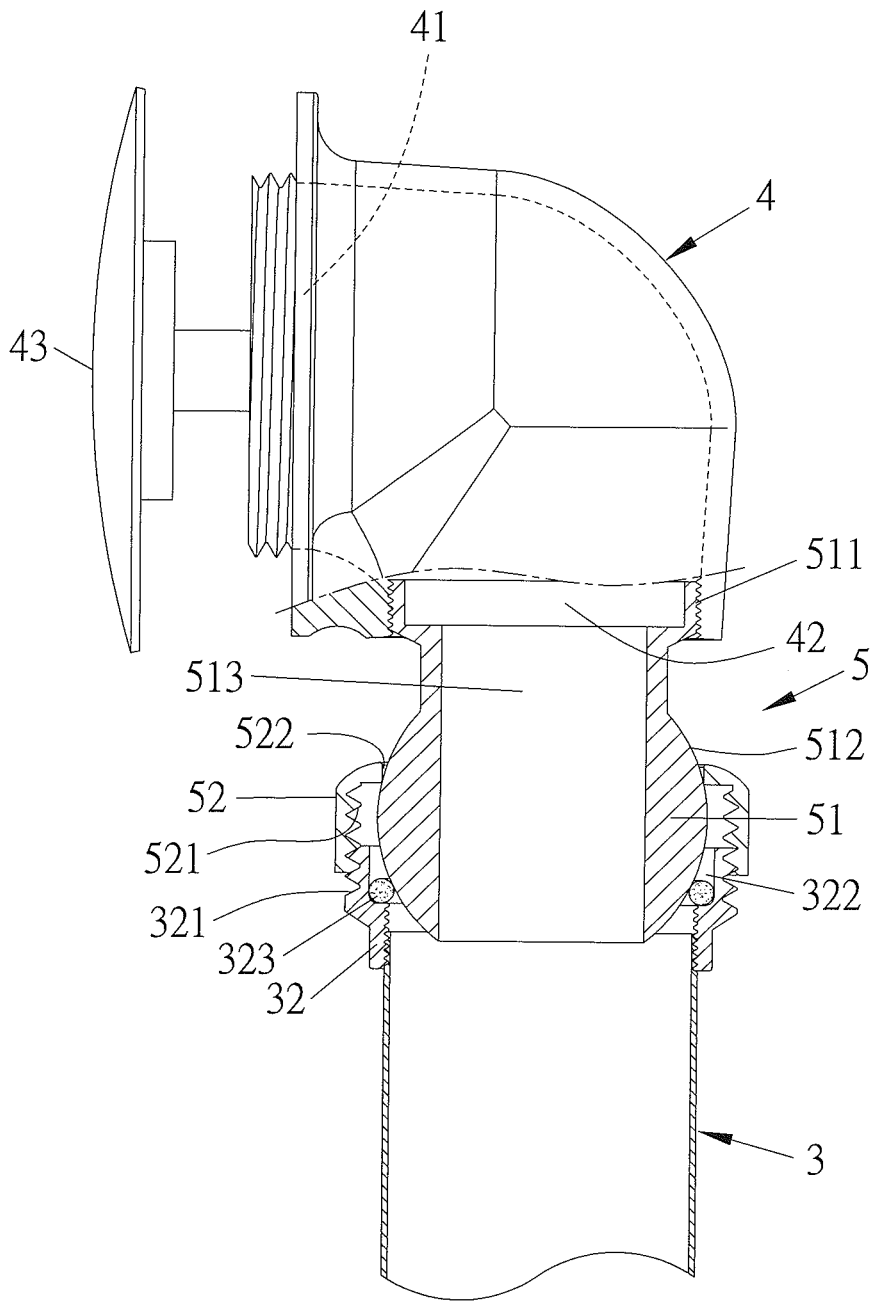
FIG. 5 is a cross sectional view showing the assembly of a part of the drainage overflow pipe structure for the bathtub according to the preferred embodiment of the present invention.

The present invention will be clearer from the following description when viewed together with the accompanying drawings, which show, for purpose of illustrations only, a preferred embodiment in accordance with the present invention.

With reference to FIGS. 3 to 6, a drainage overflow pipe A1 according to a preferred embodiment of the present invention is mounted on a bathtub A2, the bathtub A2 includes a water storage tank A21, the water storage tank A21 has a bottom A211 and a peripheral wall A212 extending upwardly from the bottom A211, the bottom A211 has a drainage hole A213 which is closed by a seal plug A214. The peripheral wall A212 has an overflow hole A215, wherein peripheral walls A212 of bathtubs A2 of various specifications have different angles. The drainage overflow pipe A1 includes a tee part 1, a drainage part 2, an overflow part 3, a pipe elbow 4, a universal rotation assembly 5, and a draining part 6.

The tee part 1 includes a first coupling orifice 11, a second coupling orifice 12, and a third coupling orifice 13 which are in communication with one another.

A first end of the drainage part 2 is inserted into the first coupling orifice 11 of the tee part 1, and a second end of the drainage part 2 is coupled with the drainage hole A213 of the bathtub A2.

The overflow part 3 includes a joining section 31 formed on a lower end thereof, and the overflow part 3 includes a connecting seat 32 arranged on an upper end thereof, the joining section 31 is accommodated in the second coupling orifice 12 of the tee part 1, the connecting seat 32 is in connection on the upper end of the overflow part 3, wherein the connecting seat 32 has outer threads 321 defined on an outer rim thereof, the connecting seat 32 has a groove-shaped holding portion 322 formed on an inner rim thereof, and the holding portion 322 has a washer 323.

The pipe elbow 4 includes an inlet 41 defined on a first end thereof, and the pipe elbow 4 includes an outlet 42 formed on a second end thereof, wherein one end of the inlet 41 couples with the overflow hole A215 of the bathtub A2, the inlet 41 has a cap 43 fixed thereon, wherein the cap 43 closes or opens the inlet 41 by pressing the cap 43 repeatedly.

The universal rotation assembly 5 is defined between and communicates with the connecting seat 32 of the overflow part 3 and the outlet 42 of the pipe elbow 4, and the universal rotation assembly 5 includes a connector 51 and a limitation member 52, wherein the connector 51 has a screwing portion 511, a spherical knob 512 connecting with the screwing portion 511, and a through orifice 513 defined in the screwing portion 511 and the spherical knob 512 so that water flows through the screwing portion 511 and the spherical knob 512. The screwing portion 511 screws with the outlet 42 of the pipe elbow 4, the spherical knob 512 fits on the holding portion 322 of the connecting seat 32 of the overflow part 3, and an outer surface of the spherical knob 512 contacts with the washer 323 of the holding portion 322 so as to avoid water leakage. The limitation member 52 is in a ring shape, and the limitation member 52 includes inner threads 521 formed on an inner wall thereof and includes an abutting portion 522 above the inner threads 521. The limitation member 52 fits on the spherical knob 512 of the connector 51, and the inner threads 521 of the limitation member 52 screws with the outer threads 321 of the connecting seat 32 of the overflow part 3 so that the abutting portion 522 of the limitation member 52 matches with the holding portion 322 of the connecting seat 32 of the overflow part 3 to force the spherical knob 512 of the connector 51, and the spherical knob 512 rotates universally and does not move, hence the universal rotation assembly 5 connects the overflow part 3 and the pipe elbow 4 together so that the overflow part 3 communicates with the pipe elbow 4, and the pipe elbow 4 rotates relative to the overflow part 3 by using the universal rotation assembly 5.

The draining part 6 couples with the third coupling orifice 13 of the tee part 1.

Figure 6:
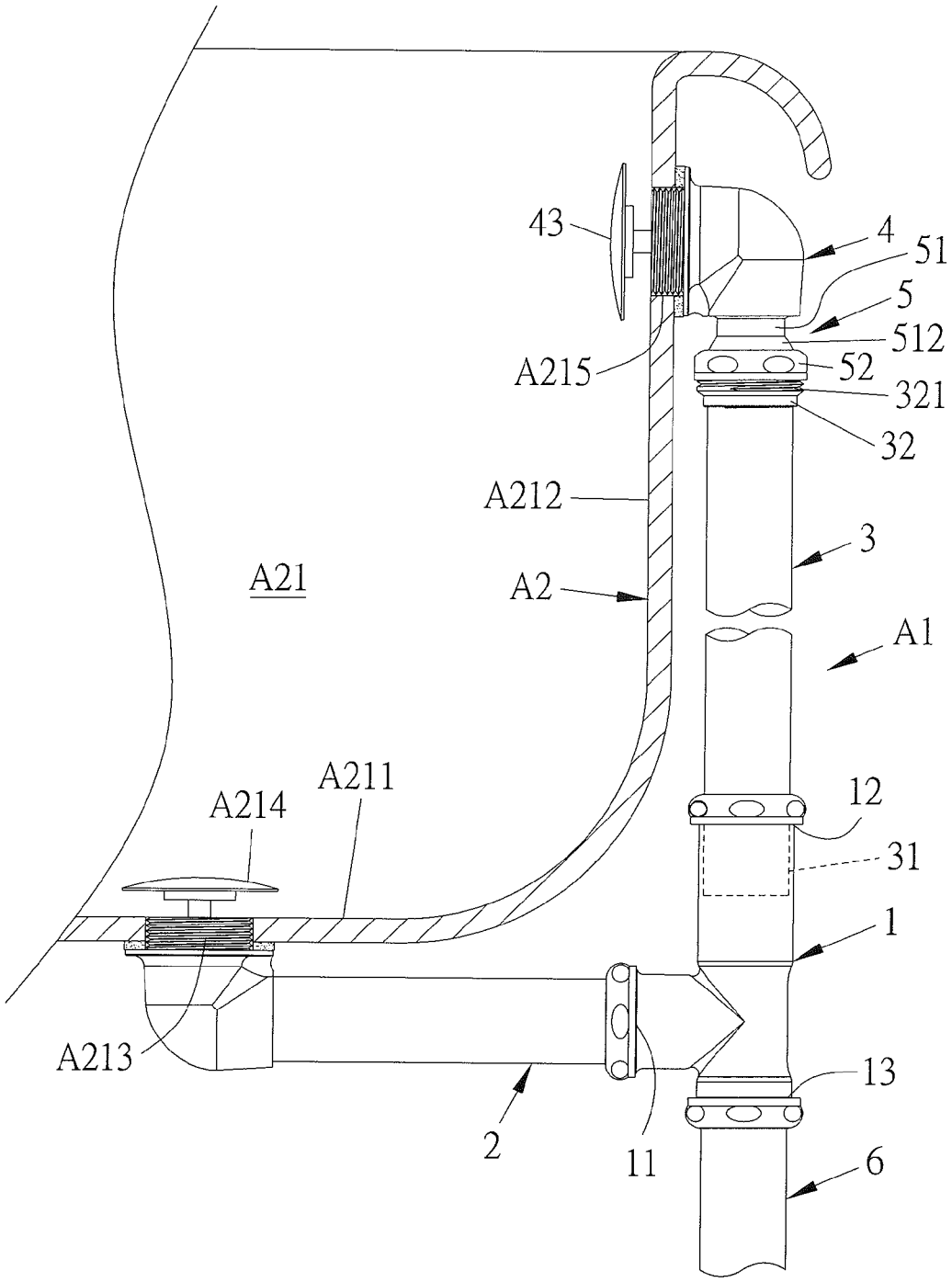
FIG. 6 is a cross sectional view showing the operation of the drainage overflow pipe structure for the bathtub according to the preferred embodiment of the present invention.
Figure 7:
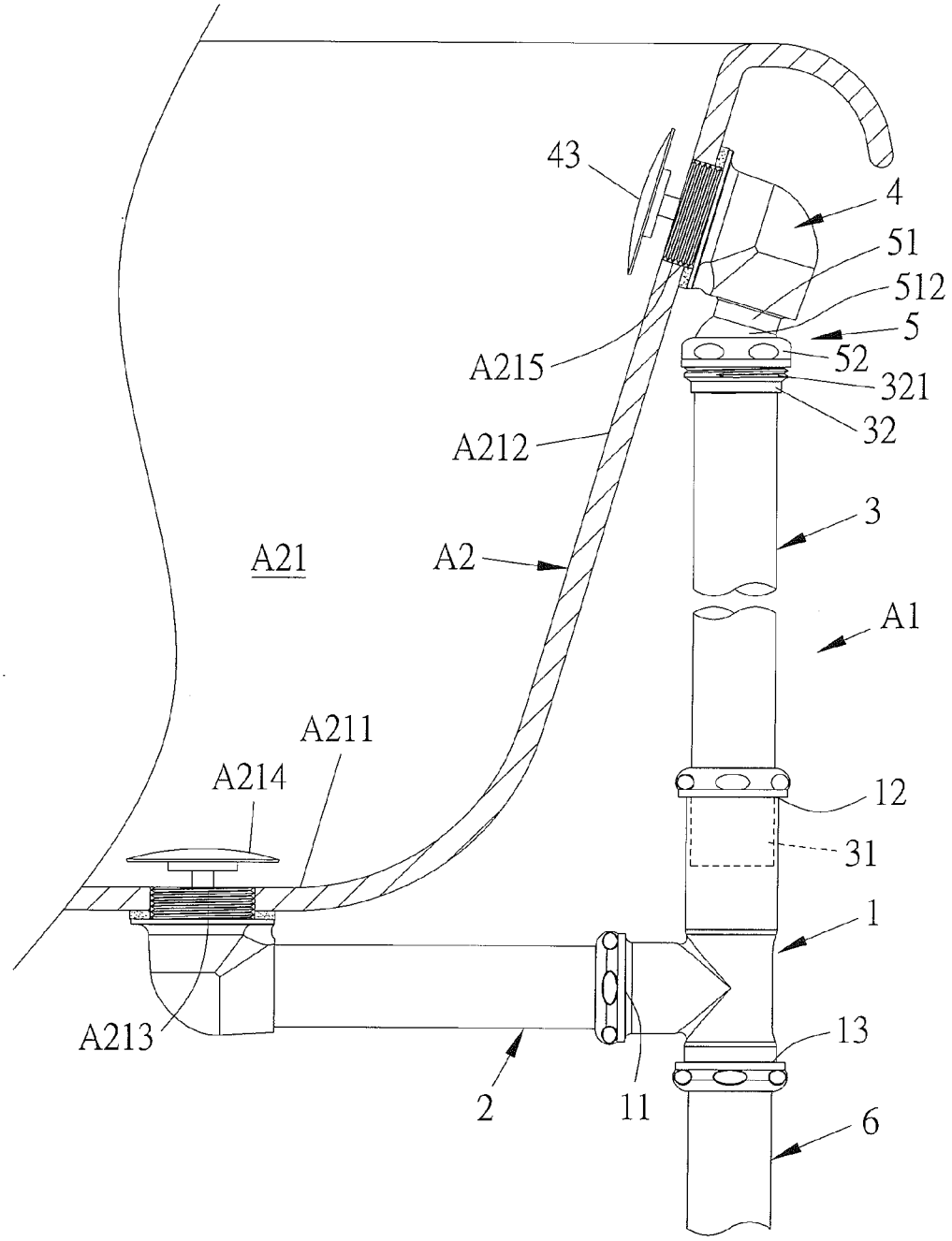
FIG. 7 is another cross sectional view showing the operation of the drainage overflow pipe structure for the bathtub according to the preferred embodiment of the present invention.

The overflow part 3 connects and communicates with the pipe elbow 4 by using the universal rotation assembly 5, as shown in FIGS. 6 and 7, when the overflow part 3 erects uprightly, the pipe elbow 4 is adjusted toward an angle by using the universal rotation assembly 5 so that the pipe elbow 4 is rotated universally based on the peripheral wall A212 of different angles of the bathtubs A2 of various specifications, and the inlet 41 of the pipe elbow 4 matingly contacts with the peripheral wall A212 of the bathtub A2, hence the pipe elbow 4 is applicable for the bathtubs A2 of various specifications.

Figure 8:
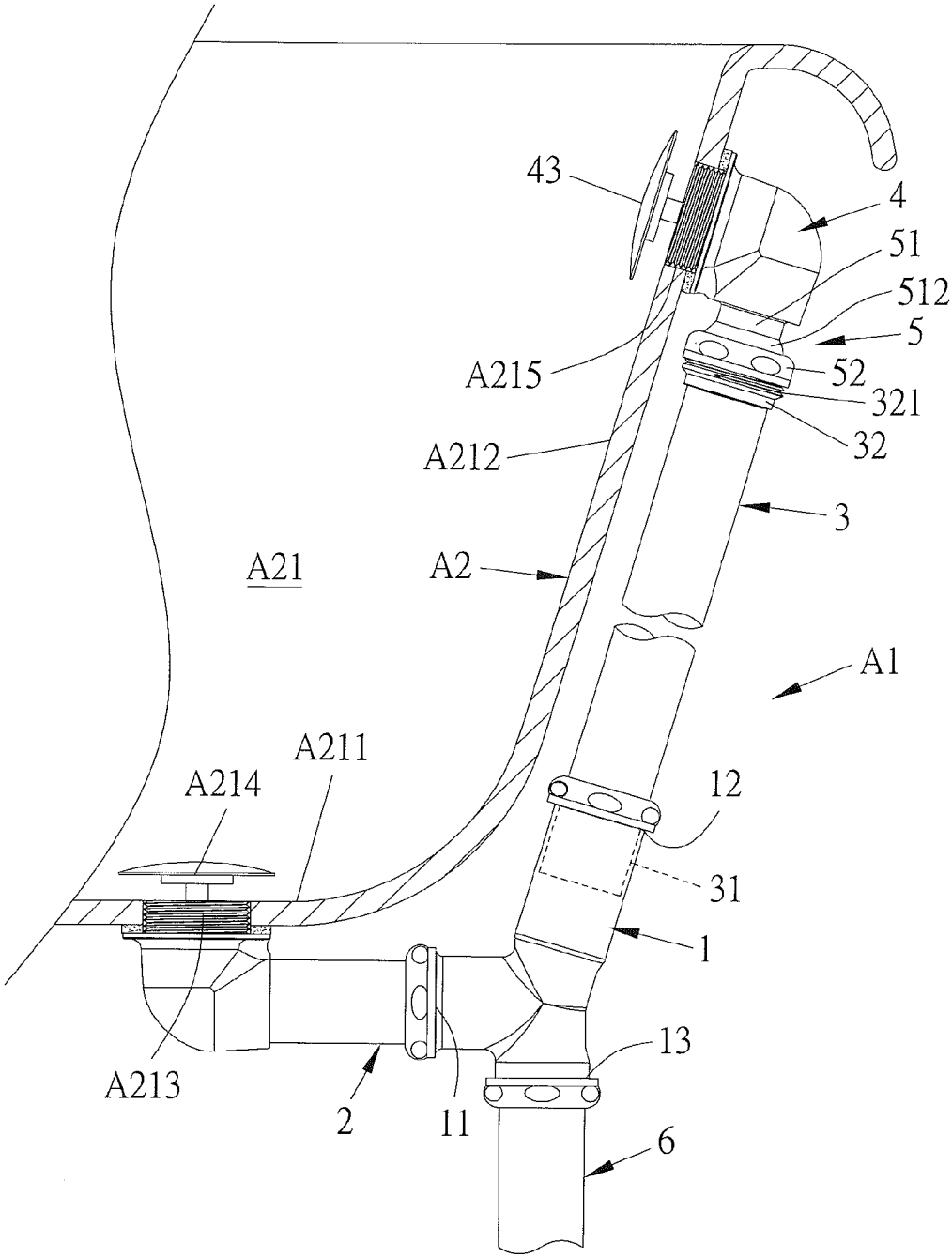
FIG. 8 is also another cross sectional view showing the operation of the drainage overflow pipe structure for the bathtub according to the preferred embodiment of the present invention.

Referring to FIG. 8, the overflow part 3 is fixed obliquely so as to mate with the bathtub A2, and the pipe elbow 4 is rotated universally by using the universal rotation assembly 5 so that the inlet 41 of the pipe elbow 4 matingly contacts with the peripheral wall A212 of the bathtubs A2, thus decreasing installation space of the overflow part 3.

Figure 9:
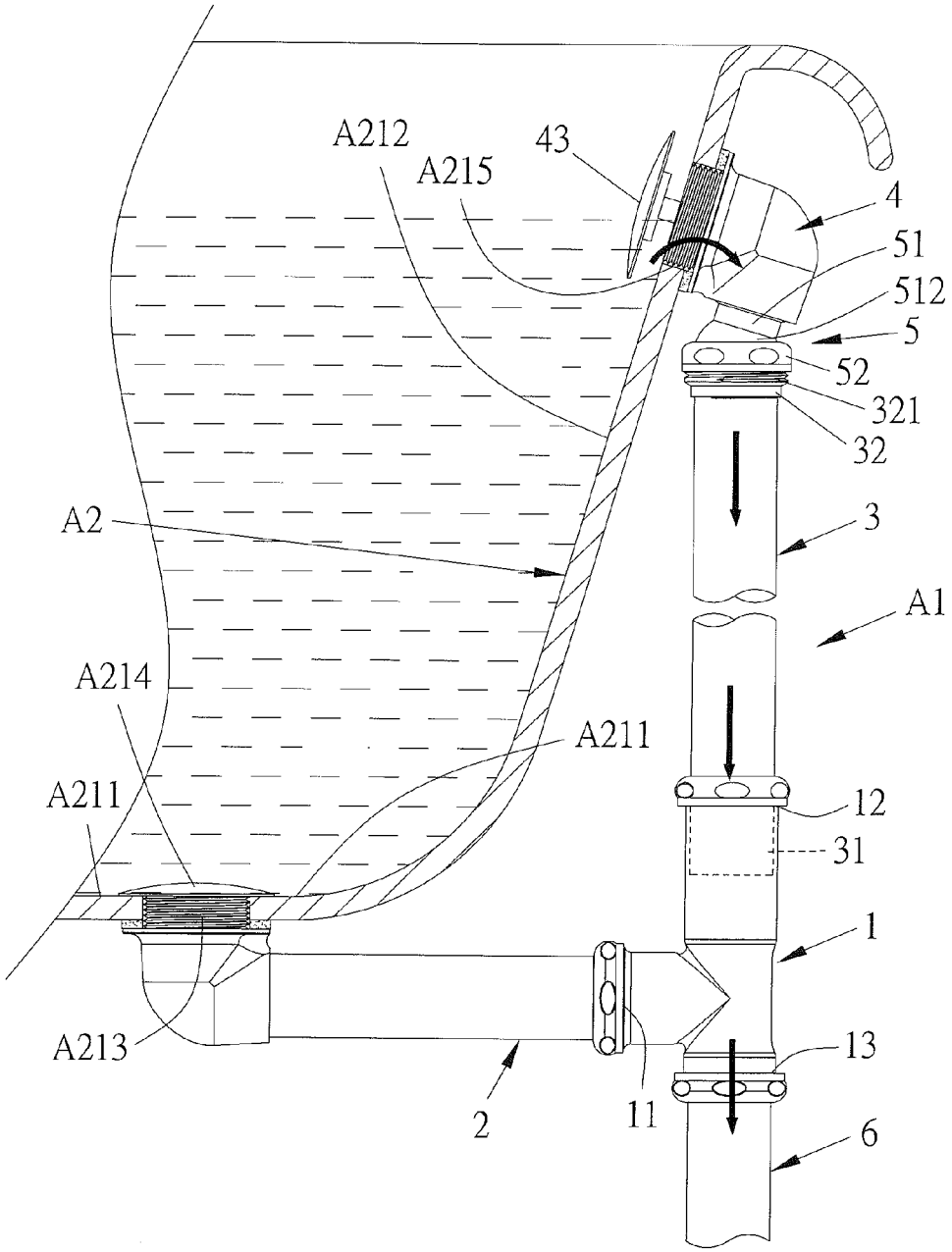
FIG. 9 is still another cross sectional view showing the operation of the drainage overflow pipe structure for the bathtub according to the preferred embodiment of the present invention.

When water level in the water storage tank A21 of the bathtub A2 is higher than the overflow hole A215, as illustrated in FIG. 9, the water in the water storage tank A21 of the bathtub A2 flows out of the draining part 6 from the overflow hole A215 via the pipe elbow 4, the through orifice 513 of the connector 51 of the universal rotation assembly 5, the overflow part 3, and the draining part 6, hence the water in the bathtub A2 is at the highest storage level and the water does not leak out of the bathtub A2.

As desiring to drain the water out of the water storage tank A21 of the bathtub A2, the seal plug A214 of the drainage hole A213 is removed so that the water in the water storage tank A21 of the bathtub A2 drains out of the draining part 6 via the drainage part 2 and the tee part 1.

Thereby, the drainage overflow pipe structure of the present invention has advantages as follows:

1. The overflow part 3 connects with the pipe elbow 4 by using the universal rotation assembly 5 so that the pipe elbow 4 is rotated universally based on the peripheral wall A212 of the bathtubs A2 of various specifications, and the inlet 41 of the pipe elbow 4 matingly contacts with the peripheral wall A212 of the bathtub A2, hence the pipe elbow 4 is applicable for the bathtubs A2 of various specifications, and the overflow pipe is mounted on the bathtub easily, thus saving installation cost and time.

2. The overflow part 3 connects and communicates with the pipe elbow 4 by using the universal rotation assembly 5 so that the overflow part 3 corresponds to the peripheral wall of the bathtub A2, and the pipe elbow 4 is rotated universally so as to correspond to the overflow part 3, hence the inlet 41 of the pipe elbow 4 matingly contacts with the peripheral wall A212 of the bathtub A2, thus decreasing installation space of the overflow part 3 and avoiding additional pipe connection because of an error of a location or an angle of the overflow part 3.

While various embodiments in accordance with the present invention have been shown and described, it is clear to those skilled in the art that further embodiments may be made without departing from the scope of the present invention.

What is claimed is:

1. A drainage overflow pipe structure for a bathtub, an overflow pipe of the drainage overflow pipe structure being mounted on a bathtub, and the bathtub including a water storage tank, the water storage tank having a bottom and a peripheral wall extending upwardly from the bottom, the bottom having a drainage hole, the peripheral wall having an overflow hole, and the drainage overflow pipe comprising:

a tee part including a first coupling orifice, a second coupling orifice, and a third coupling orifice;

a drainage part, a first end of which is connected with the first coupling orifice of the tee part, and a second end of the drainage part being coupled with the drainage hole of the bathtub;

an overflow part including a joining section formed on a lower end of the overflow part, and the overflow part including a connecting seat arranged on an upper end of the overflow part, the joining section being accommodated in the second coupling orifice of the tee part, the connecting seat having outer threads defined on an outer rim of the connecting seat, and the connecting seat having a groove-shaped holding portion formed in an inner rim of the connecting seat;

a pipe elbow including an inlet defined on a first end of the pipe elbow and coupling with the overflow hole, and the pipe elbow including an outlet formed on a second end of the pipe elbow; and a universal rotation assembly including a connector and a limitation member, wherein the connector has a screwing portion, a spherical knob, and a through orifice defined in the screwing portion and the spherical knob so that water flows through the screwing portion and the spherical knob, the screwing portion screws with the outlet of the pipe elbow, the spherical knob fits on the holding portion of the connecting seat of the overflow part, the limitation member is in a ring shape, and the limitation member includes inner threads formed on an inner wall thereof and includes an abutting portion above the inner threads, the limitation member fits on the spherical knob of the connector, and the inner threads of the limitation member screws with the outer threads of the connecting seat of the overflow part so that the abutting portion of the limitation member matches with the holding portion of the connecting seat of the overflow part to force the spherical knob of the connector, and the spherical knob rotates universally and does, not move, hence the overflow part connects and communicates with the pipe elbow by using the universal rotation assembly, and the pipe elbow rotates relative to the overflow part by using the universal rotation assembly.

2. The drainage overflow pipe structure as claimed in claim 1, wherein the connecting seat of the overflow part is screwed on an upper end of the overflow part.

3. The drainage overflow pipe structure as claimed in claim 1, wherein the holding portion of the connecting seat of the overflow part has a washer contacts with an outer surface of the spherical knob.

4. The drainage overflow pipe structure as claimed in claim 1 further comprising a draining part coupling with the third coupling orifice of the tee part.

* * * * *